US010699720B2

(12) United States Patent
Choo

(10) Patent No.: US 10,699,720 B2
(45) Date of Patent: Jun. 30, 2020

(54) ENERGY LOSSLESS CODING METHOD AND APPARATUS, SIGNAL CODING METHOD AND APPARATUS, ENERGY LOSSLESS DECODING METHOD AND APPARATUS, AND SIGNAL DECODING METHOD AND APPARATUS

(71) Applicant: SAMSUNG ELECTRONICS CO., LTD., Suwon-si (KR)

(72) Inventor: Ki-hyun Choo, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/673,237

(22) Filed: Nov. 4, 2019

(65) Prior Publication Data

US 2020/0066285 A1 Feb. 27, 2020

Related U.S. Application Data

(63) Continuation of application No. 15/021,833, filed as application No. PCT/KR2014/008586 on Sep. 15, 2014, now Pat. No. 10,468,033.

(Continued)

(51) Int. Cl.
*G10L 19/22* (2013.01)
*G10L 19/002* (2013.01)

(Continued)

(52) U.S. Cl.
CPC ..... *G10L 19/0017* (2013.01); *G10L 19/002* (2013.01); *G10L 19/18* (2013.01); *G10L 19/22* (2013.01)

(58) Field of Classification Search
CPC ..... G10L 19/06; G10L 19/17; G10L 19/22

(Continued)

(56) References Cited

U.S. PATENT DOCUMENTS 6,349,284 B1 2/2002 Park et al.
6,487,535 B1 * 11/2002 Smyth ..... G10L 19/0208 704/500

(Continued)

FOREIGN PATENT DOCUMENTS

CA 2832032 A1 10/2012
CN 1241844 A 1/2000

(Continued)

OTHER PUBLICATIONS

Communication dated Jan. 15, 2019, issued by the Japanese Patent Office in counterpart Japanese Application No. 2018-036831.

(Continued)

*Primary Examiner* — Paras D Shah
*Assistant Examiner* — Timothy Nguyen
(74) *Attorney, Agent, or Firm* — Sughrue Mion, PLLC

(57) ABSTRACT

The lossless coding method includes selecting one of a first coding method and a second coding method, based on a range in which a quantization index of energy is represented, and coding the quantization index by using the selected coding method. The lossless decoding method includes determining a coding method of a differential quantization index of energy included in a bitstream and decoding the differential quantization index by using one of a first decoding method and a second decoding method based on a range in which a quantization index of energy is represented, in response to the determined coding method.

7 Claims, 12 Drawing Sheets

Related U.S. Application Data

(60) Provisional application No. 61/877,540, filed on Sep. 13, 2013.

(51) Int. Cl.
*G10L 19/18* (2013.01)
*G10L 19/00* (2013.01)

(58) Field of Classification Search
USPC ..... 704/500
See application file for complete search history.

(56) References Cited

U.S. PATENT DOCUMENTS

| | | | | |
|---|---|---|---|---|
| 7,302,005 | B2 | 11/2007 | Bruekers et al. | |
| 7,605,727 | B2 | 10/2009 | Sung et al. | |
| 7,630,902 | B2 * | 12/2009 | You | G10L 19/025 375/240 |
| 7,660,720 | B2 | 2/2010 | Oh et al. | |
| 8,155,973 | B2 | 4/2012 | Heo | |
| 8,315,880 | B2 * | 11/2012 | Kovesi | G10L 19/032 704/229 |
| 8,326,618 | B2 | 12/2012 | Jax et al. | |
| 8,724,734 | B2 | 5/2014 | Sasaki et al. | |
| 10,194,151 | B2 | 1/2019 | Sung et al. | |
| 2004/0125003 | A1 * | 7/2004 | Craven | H03M 7/3046 341/76 |
| 2008/0112632 | A1 | 5/2008 | Vos et al. | |
| 2009/0030678 | A1 * | 1/2009 | Kovesi | G10L 19/032 704/230 |
| 2009/0100121 | A1 * | 4/2009 | Mittal | G10L 19/035 708/495 |
| 2011/0317843 | A1 | 12/2011 | Lang et al. | |
| 2013/0110522 | A1 * | 5/2013 | Choo | G10L 21/00 704/500 |
| 2014/0156284 | A1 | 6/2014 | Porov et al. | |
| 2016/0232903 | A1 | 8/2016 | Choo | |
| 2019/0122682 | A1 | 4/2019 | Liu et al. | |

FOREIGN PATENT DOCUMENTS

| | | | |
|---|---|---|---|
| CN | 1299536 | A | 6/2001 |
| CN | 1681213 | A | 10/2005 |
| CN | 101188878 | A | 5/2008 |
| CN | 101390158 | A | 3/2009 |
| CN | 101432802 | A | 5/2009 |
| CN | 101911501 | A | 12/2010 |
| CN | 101937680 | A | 1/2011 |
| CN | 105723454 | A | 6/2016 |
| EP | 1 883 067 | A1 | 1/2008 |
| EP | 2256723 | A1 | 12/2010 |
| EP | 3 046 104 | A1 | 7/2016 |
| JP | 2016-535317 | A | 11/2016 |
| KR | 10-0903109 | B1 | 6/2009 |
| KR | 10-2012-0135118 | A | 12/2012 |
| KR | 10-2013-0044193 | A | 5/2013 |
| KR | 10-2015-0031215 | A | 3/2015 |
| WO | 2012/144127 | A1 | 10/2012 |

OTHER PUBLICATIONS

Communication dated Mar. 5, 2019, issued by the State Intellectual Property Office of P.R. China in counterpart Chinese Application No. 201480062275.6.

Communication dated Mar. 2, 2017, issued by the European Patent Office in counterpart European application No. 14844584.4.

International Search Report and Written Opinion, issued by International Searching Authority in corresponding International Application No. PCT/KR2014/008586, dated Dec. 2, 2014 (PCT/ISA/210 & PCT/ISA/237).

Communication dated Oct. 22, 2019 issued by the State Intellectual Property Office of P.R. China in counterpart Chinese Application No. 201480062275.6.

* cited by examiner

FIG. 5

| Coding Method index DENG_CMODE (1bit) | Coding Method | Coding Mode index (1bit) | Description |
|---|---|---|---|
| 0 | Large Symbol method | 0 | Pulse mode |
| | | 1 | Scale mode |
| 1 | Small symbol method | 0 | Context based Huffman coding mode |
| | | 1 | Re-sized Huffman coding mode |

FIG. 6

| Index | Code |
|---|---|
| −4 | 0001011 |
| −3 | 00011 |
| −2 | 001 |
| −1 | 01 |
| 0 | 1 |
| 1 | 0000 |
| 2 | 000100 |
| 3 | 0001010 |

| | $cmd_0$ | $cmd_1$ | $ind_{l_0}$ | $ind_{pls}$ | $\Delta l_M(0)$ | $pls_{pos}$ | $pls_{amp}$ | Huffman bits |
|---|---|---|---|---|---|---|---|---|
| bits | 1 | 1 | 1 | 1 | 7 | 5 | 7 | – |

| Group Index | Lower bound | Upper bound | Probability model |
|---|---|---|---|
| 0 | – | 12 | 0 |
| 1 | 13 | 17 | 1 |
| 2 | 18 | – | 0 |

ENERGY LOSSLESS CODING METHOD AND APPARATUS, SIGNAL CODING METHOD AND APPARATUS, ENERGY LOSSLESS DECODING METHOD AND APPARATUS, AND SIGNAL DECODING METHOD AND APPARATUS

CROSS-REFERENCE TO RELATED APPLICATIONS

This application is a continuation application of U.S. patent application Ser. No. 15/021,833, filed on Mar. 14, 2016, which is a national stage application of International Application No. PCT/KR2014/008586 filed on Sep. 15, 2014, which claims the benefit of U.S. Provisional Application No. 61/877,540, filed on Sep. 13, 2013, in the U.S. Patent and Trademark Office, the disclosures of which are incorporated herein in their entireties by reference.

TECHNICAL FIELD

One or more exemplary embodiments relate to coding and decoding of an audio signal or a speech signal, and more particularly, to an energy lossless coding method and apparatus, a signal coding method and apparatus, an energy lossless decoding method and apparatus, a signal decoding method and apparatus, and a multimedia device employing the same, in which the number of bits used to code energy information of a spectrum within a limited bit range is reduced without increasing complexity or degrading a quality of a reconstructed sound, and thus, the number of bits used to code an actual frequency component of the spectrum increases.

BACKGROUND ART

In coding an audio signal or a speech signal, in addition to an actual frequency component of a spectrum, side information such as energy or an envelope may be added into a bitstream. In this case, the number of bits allocated for coding a frequency component of a spectrum increases by reducing the number of bits allocated for coding side information in a state where loss is minimized.

That is, in a case of coding or decoding an audio signal or a speech signal, it is required to reconstruct the audio signal or the speech signal having the best quality of a sound in a corresponding bit range by efficiently using limited bits especially at a low bit rate.

DISCLOSURE

Technical Problems

One or more exemplary embodiments include an energy lossless coding method, a signal coding method, an energy lossless decoding method, and a signal decoding method, in which without increasing complexity or degrading a quality of a reconstructed sound, the number of bits used to code an envelope or energy of a spectrum within a limited bit range is reduced and, the number of bits used to code an actual frequency component of the spectrum increases.

One or more exemplary embodiments include an energy lossless coding apparatus, a signal coding apparatus, an energy lossless decoding apparatus, and a signal decoding apparatus, in which without increasing complexity or degrading a quality of a reconstructed sound, the number of bits used to code energy of a spectrum within a limited bit range is reduced and, the number of bits used to code an actual frequency component of the spectrum increases.

One or more exemplary embodiments include a non-transitory computer-readable storage medium storing a program for executing an energy lossless coding method, a signal coding method, an energy lossless decoding method, or a signal decoding method in a computer.

One or more exemplary embodiments include a multimedia device using an energy lossless coding apparatus, a signal coding apparatus, an energy lossless decoding apparatus, or a signal decoding apparatus.

Technical Solution

According to one or more exemplary embodiments, a lossless coding method includes: selecting one of a first coding method and a second coding method, based on a range in which a quantization index of energy is represented; and coding the quantization index by using the selected coding method.

According to one or more exemplary embodiments, a signal coding method includes: quantizing energy which is obtained in units of a band from a spectrum coefficient generated from an audio signal of a time domain; selecting a coding method to lossless-code an quantization index of energy, in consideration of the number of bits representing the quantization index of energy and the number of bits which are obtained by coding the quantization index of the energy based on a large symbol coding method and a small symbol coding method, respectively; allocating a bit for coding in units of a band, based on restored energy; and quantizing and lossless-coding the spectrum coefficient, based on the allocated bit.

According to one or more exemplary embodiments, a lossless decoding method includes: determining a coding method of a differential quantization index of energy included in a bitstream; and decoding the differential quantization index by using one of a first decoding method and a second decoding method in response to the determined coding method, wherein the first decoding method and the second decoding method is based on a range in which a quantization index of energy is represented.

According to one or more exemplary embodiments, a lossless decoding method includes: determining a coding method of a coded differential quantization index of energy obtained from a bitstream, and decoding the coded differential quantization index by using one of a large symbol decoding method and a small symbol decoding method, in response to the determined coding method; dequantizing the decoded differential quantization index, and allocating a bit for decoding in units of a band, based on restored energy; lossless-decoding a spectrum coefficient obtained from the bitstream; and dequantizaing the lossless-decoded spectrum coefficient, based on the allocated bit.

Advantageous Effects

According to the one or more of exemplary embodiments, a symbol where a representation range is large in a quantization index indicating energy is coded by using one of the pulse mode and the scale mode. Accordingly, the number of bits used to code energy is reduced, and thus, more bits are allocated for coding a spectrum.

DESCRIPTION OF DRAWINGS

FIG. 5 is a table showing a coding method and a coding mode according to an exemplary embodiment;

FIG. 6 is a diagram illustrating an example of a Huffman coding table which is used in a large symbol coding method;

MODE FOR INVENTION

Figure 1:
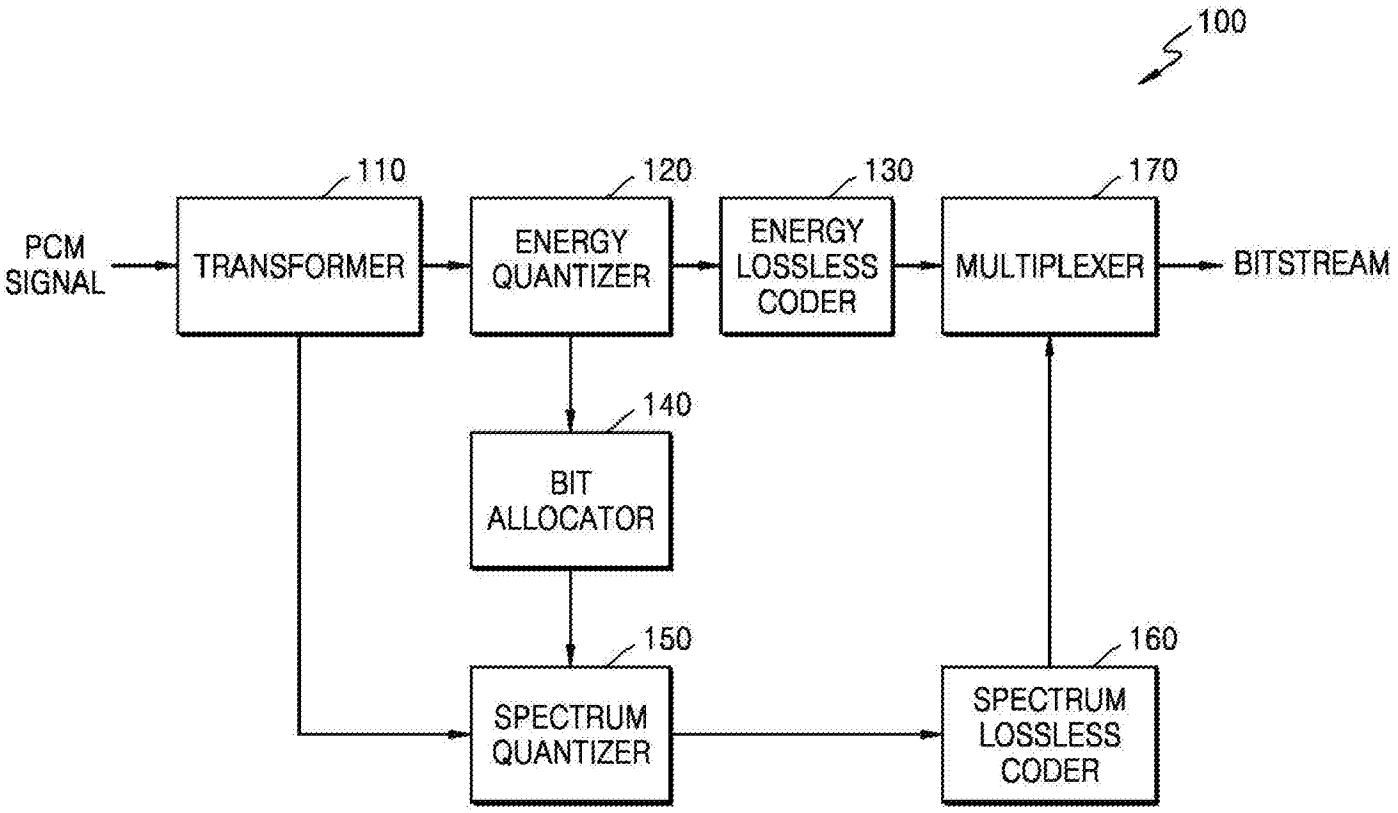
FIG. 1 is a block diagram illustrating a configuration of an audio coding apparatus according to an exemplary embodiment.

Since the inventive concept may have diverse modified embodiments, preferred embodiments are illustrated in the drawings and are described in the detailed description of the inventive concept. However, this does not limit the inventive concept within specific embodiments and it should be understood that the inventive concept covers all the modifications, equivalents, and replacements within the idea and technical scope of the inventive concept. Moreover, detailed descriptions related to well-known functions or configurations will be ruled out in order not to unnecessarily obscure subject matters of the inventive concept.

It will be understood that although the terms of first and second are used herein to describe various elements, these elements should not be limited by these terms. Terms are only used to distinguish one component from other components.

In the following description, the technical terms are used only for explain a specific exemplary embodiment while not limiting the inventive concept. Terms used in the inventive concept have been selected as general terms which are widely used at present, in consideration of the functions of the inventive concept, but may be altered according to the intent of an operator of ordinary skill in the art, conventional practice, or introduction of new technology. Also, if there is a term which is arbitrarily selected by the applicant in a specific case, in which case a meaning of the term will be described in detail in a corresponding description portion of the inventive concept. Therefore, the terms should be defined on the basis of the entire content of this specification instead of a simple name of each of the terms.

The terms of a singular form may include plural forms unless referred to the contrary. The meaning of 'comprise', 'include', or 'have' specifies a property, a region, a fixed number, a step, a process, an element and/or a component but does not exclude other properties, regions, fixed numbers, steps, processes, elements and/or components.

Hereinafter, exemplary embodiments will be described in detail with reference to the accompanying drawings. Like numbers refer to like elements throughout the description of the figures, and a repetitive description on the same element is not provided.

FIG. 1 is a block diagram illustrating a configuration of an audio coding apparatus according to an exemplary embodiment.

The signal coding apparatus 100 of FIG. 1 may include a transformer 110, an energy quantizer 120, an energy lossless coder 130, a bit allocator 140, a spectrum quantizer 150, a spectrum lossless coder 160, and a multiplexer 170. The multiplexer 170 may be optionally provided and may be replaced by another element that performs a bit packing function. Alternatively, lossless coded energy data and lossless coded spectrum data may construct a separate bitstream and may be stored or transmitted. The signal coding apparatus 100 may further include a normalizer (not shown) that performs normalization by using an energy value after or before a spectrum quantizing operation. Each of the elements may be integrated into one or more modules and may be implemented with one or more processors (not shown). Here, a signal may denote a media signal such as a sound indicating an audio, music, a speech, or a mixed signal thereof, but hereinafter, for convenience of explanation, the signal is referred to as an audio signal. An audio signal of a time domain input to the signal coding apparatus 100 may have various sampling rates, and a band configuration of energy used to quantize a spectrum for each sampling rate may be changed. Therefore, the number of quantized energy for which lossless coding is performed may be varied. Examples of a sampling rate may include 7.2 kHz, 8 kHz, 13.2 kHz, 16.4 kHz, 32 kHZ, and 48 kHz, but are not limited thereto. An audio signal of a time domain where a sampling rate and a target bit rate are determined may be provided to the transformer 110.

In FIG. 1, the transformer 110 may transform an audio signal of a time domain (for example, a pulse code modulation (PCM) signal) into a frequency domain to generate an audio spectrum. In this case, time-to-frequency domain transform may be performed by using known various methods such as modified discrete cosine transform (MDCT). Transform coefficients (for example, MDCT coefficients) of an audio spectrum obtained from the transformer 110 may be provided to the energy quantizer 120 and the spectrum quantizer 150.

The energy quantizer 120 may obtain, in units of a band, energy from the transform coefficients provided from the transformer 110. The band is a unit of grouping samples of the audio spectrum and may have a uniform or non-uniform length while reflecting a critical band. When non-uniformity, a band may be set so that the number of samples included in one band progressively increases in a direction from a start sample to a last sample for one frame. Also, in a case of supporting multiple bit rates, a band may be set so that the numbers of samples included in respective bands which correspond to each other at different bit rates are equal. The number of bands included in one frame or the number of samples included in a band may be predetermined. An energy value may indicate an envelope of transform coefficients included in a band and denote average amplitude, average energy, power, or a norm value. Here, the band may denote a parameter band or a scale factor band.

Energy $E_M(b)$ of a band b may be calculated, for example, as expressed in the following Equation (1).

$$E_M(b) = \log 2\left(\sum_{k=k_{start(b)}}^{k=k_{end(b)}-1} X_M(k)^2 + Epsi\ lon\right), \quad b = 0, \ldots, N_{bands} - 1 \qquad \text{Equation (1)}$$

where $X_M(k)$ denotes a spectrum coefficient, $k_{start(b)}$ denotes a start sample, and $k_{end(b)}$ denotes a last sample of a band.

The energy quantizer 120 may quantize the obtained energy to generate an index. According to an exemplary embodiment, in a case of a transient mode, by reordering energy to be quantized before quantization, for example, by performing a reordering operation so that energies corresponding to an even subframe (an index m=0, 2) are in a frequency increasing order and energies corresponding to an odd subframe (an index m=1, 3) are in a frequency decreasing order, efficient energy differential coding may be achieved. In each frame, energy may be scalar-quantized with a quantization step size, for example, a uniform scalar quantizer value $q_{int}$. The uniform scalar quantizer value $q_{int}$ may be variable, and for example, may be selected based on a bandwidth and a mode.

A quantization index $I_M(b)$ of energy may be calculated, for example, as expressed in the following Equation (2).

$$I_M(b) = \text{round}\left(\frac{E_M(b)}{q_{int}}\right), b = 0, \ldots, N_{bands} - 1 \qquad \text{Equation (2)}$$

According to an exemplary embodiment, quantization indices of pieces of sub-vector energy may be differentially coded. To this end, a difference (i.e., a differential index) between a quantization index of a current band and a quantization index of a previous band may be obtained for the current band. In this case, since there is no band previous to a first band in a frame, a differential index of the first band may be obtained by subtracting a certain value from a quantization index of the first band. The differential index $\Delta I_M(0)$ of the first band and a differential index $\Delta I_M(b)$ of the other band may be calculated, for example, as expressed in the following Equation (3).

$$\Delta I_M(0) = I_M(0) - \text{round}\left(\frac{I_{ref}}{q_{int}}\right) \qquad \text{Equation (3)}$$
$$\Delta I_M(b) = I_M(b) - I_M(b-1), b = 1, \ldots, N_{bands} - 1$$

where $I_{ref}$ denotes a reference band energy and may be set to 24.

According to an exemplary embodiment, the differential index $\Delta I_M(b)$ may be constrained into a certain range, for example, a range of [−256, 256]. This may be achieved by first adjusting a negative differential index and then adjusting a positive differential index as expressed in the following Equation (4).

$$\begin{aligned} &\text{if } \Delta I_M(b) < -256 \\ &\Delta I_M(b) = -256 \\ &\text{end} \\ &\text{if } \Delta I_M(b) > 255 \\ &\Delta I_M(b) = 255 \\ &\text{end} \\ &b = 0, \ldots, N_{bands} - 1 \end{aligned} \qquad \text{Equation (4)}$$

The energy lossless coder 130 may perform lossless coding on an index, a differential index, or a constrained differential index provided from the energy quantizer 120. According to an exemplary embodiment, the energy lossless coder 130 may perform lossless coding in units of a frame by using either a first coding method or a second coding method, based on a range or a capability required to represent a differential index and bit consumption. Here, the first coding method is a large symbol coding method, and may be applied when the number of symbols required to represent an index is relatively larger than the second coding method. The second coding method is a small symbol coding method, and may be applied when the number of symbols required to represent an index is relatively smaller than the first coding method. When the large symbol coding method is selected as a coding method, band energy may be coded in either a pulse mode or a scale mode. When the small symbol coding method is selected as a coding method, an upper bit and a lower bit may be separately coded. In detail, the upper bit may be coded in either a context-based Huffman coding mode or a resized Huffman coding mode, and the lower bit may be processed through bit packing. A coding method index indicating a coding method (i.e., a flag bit DENG_CMODE) and a coding mode index indicating a coding mode in each coding method (i.e., a flag bit LC_MODE) may be added into a bitstream as side information, and may be transmitted to a decoder. Such an energy or envelope coding mode may be expressed as illustrated in FIG. 5.

According to an exemplary embodiment, the energy lossless coder 130 may select a coding mode, based on an estimated number of bits which are consumed by the context-based Huffman coding mode and the resized Huffman coding mode, respectively, in the small symbol coding method.

The bit allocator 140 may dequantize a quantization index provided from the energy quantizer 120 to restore energy. The bit allocator 140 may calculate a masking threshold value by using the energy restored in units of a band, for the total number of bits based on a target bit rate and determine the number of allocation bits necessary for the perceptual coding of each band in units of an integer or in units of a fraction, based on the masking threshold value. In detail, the bit allocator 140 may estimate the number of allowable bits by using the energy restored in units of a band to allocate a bit, and limit the number of allocation bits so as not to exceed the number of allowable bits. In this case, bits may be sequentially allocated from a band where energy is large. Also, more bits may be allocated to a perceptually important band by applying a weight value to energy of each band according to a perceptual significance of each band. The perceptual significance, for example, may be determined through a psychoacoustic weighting in ITU-T G.719.

The spectrum quantizer 150 may quantize transform coefficients provided from the transformer 110 by using the number of allocation bits determined in units of a band to generate a quantization index of a spectrum.

The spectrum lossless coder 160 may perform lossless coding on the quantization index of the spectrum provided from the spectrum quantizer 150. As an example of a lossless coding algorithm, a known algorithm such as Huffman coding or factorial pulse coding (FPC) may be used. Data obtained as a result of lossless coding may be added into a bitstream and may be stored or transmitted.

The multiplexer 170 may generate a bitstream from energy data provided from the energy lossless coder 130 and spectrum data supplied from the spectrum lossless coder 160.

Figure 2:
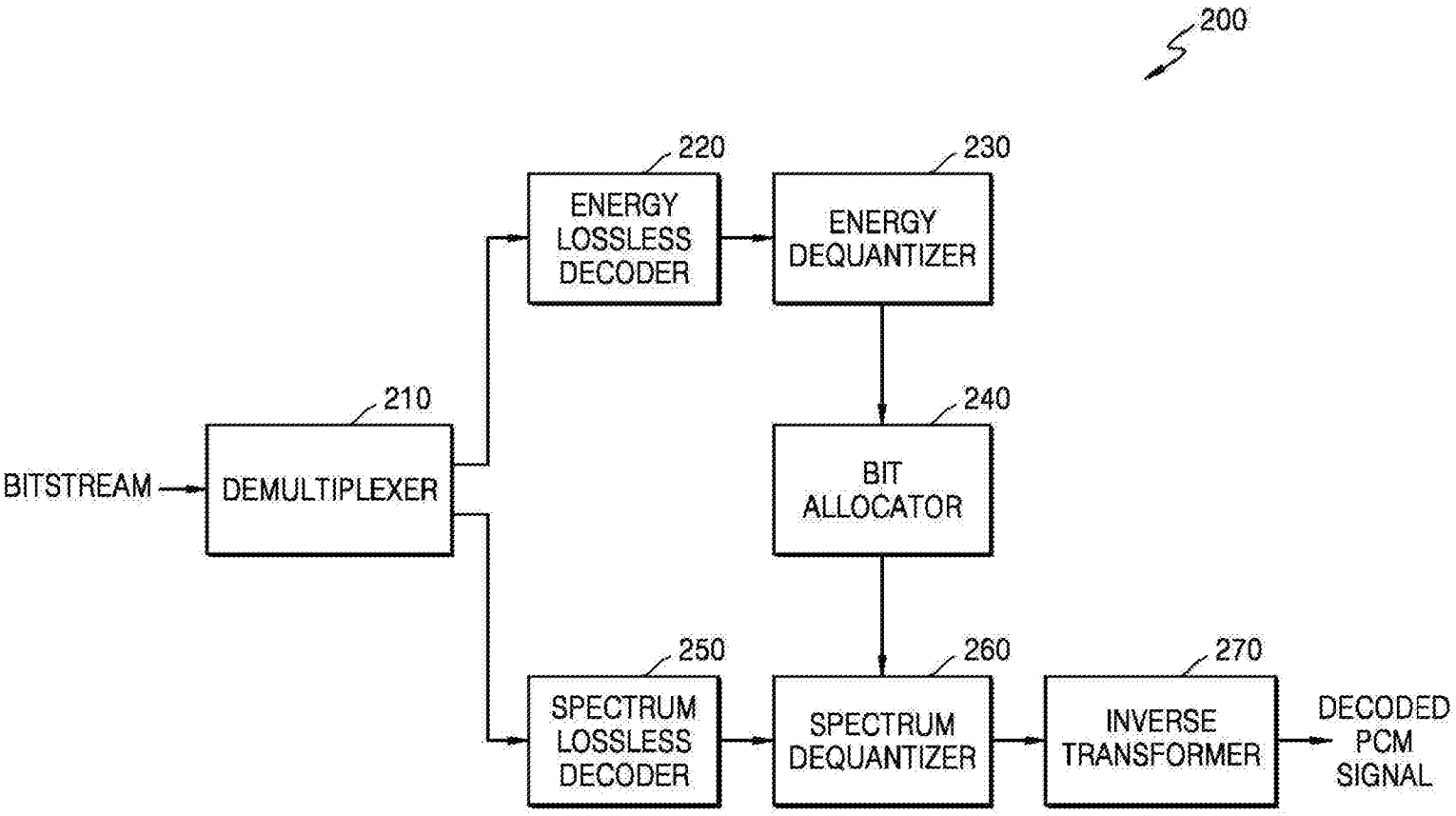
FIG. 2 is a block diagram illustrating a configuration of an audio decoding apparatus according to an exemplary embodiment.

FIG. 2 is a block diagram illustrating a configuration of an audio decoding apparatus 200 according to an exemplary embodiment.

The audio decoding apparatus 200 of FIG. 2 may include a demultiplexer 210, an energy lossless decoder 220, an energy dequantizer 230, a bit allocator 240, a spectrum lossless decoder 250, a spectrum dequantizer 260 and an inverse transformer 270. Each of the elements may be integrated into one or more modules and may be implemented with one or more processors (not shown). Similarly to the audio encoding apparatus 100, the demultiplexer 210 may be optionally provided and may be replaced by another element that performs a bit unpacking function. The signal decoding apparatus 200 may further include a de-normalizer (not shown) that performs de-normalization by using an energy value after or before a spectrum dequantizing operation.

In FIG. 2, the demultiplexer 210 may provide coded energy data, by parsing a bitstream, to the energy lossless decoder 220 and provide coded spectrum data to the spectrum lossless decoder 250.

The energy lossless decoder 220 may lossless-decode the coded energy data to obtain a quantization index of energy. According to an exemplary embodiment, when differential coding is performed by a coding end, a differential quantization index may be obtained. When the differential quantization index is obtained, a quantization index of each band may be reconstructed as expressed in the following Equation (5).

$$I'_M(0)=\Delta I_M(0)+I_{ref}$$

$$I'_M(b)=\Delta I_M(b)+I'_M(b-1),\ b=1,\ldots,N_{bands}-1 \qquad \text{Equation (5)}$$

The energy dequantizer 230 may dequantize the quantization index of the energy provided from the energy lossless decoder 220 to reconstruct energy. In detail, the energy dequantizer 230 may multiply the quantization index of the energy by a quantization step size (for example, the uniform scalar quantizer value $q_{int}$) to reconstruct the energy.

The bit allocator 240 may perform bit allocation of an integer or a fraction unit in units of a frequency band by using the reconstructed energy provided from the energy dequantizer 230. In detail, bits by sample may be sequentially allocated from a band where energy is large. That is, a bit for each sample may be first allocated to a band having the maximum energy, and by reducing energy of a corresponding band by a certain unit, a priority may be changed such that a bit may be allocated to another band. Such an operation is repeatedly performed until a total of bits available for a given frame are all consumed. An operation of the bit allocator 240 is substantially the same as the bit allocator 140 of the audio coding apparatus 100.

The spectrum lossless decoder 250 may perform lossless decoding on the coded spectrum data to obtain a spectrum quantization index.

The spectrum dequantizer 260 may dequantize the spectrum quantization index provided from the spectrum lossless decoder 250 by using the number of allocation bits determined in units of a band, thereby reconstructing a spectrum transform coefficient.

The inverse transformer 250 may inverse-transform the spectrum transform coefficient provided from the spectrum dequantizer 260 to reconstruct an audio signal of a time domain.

Figure 3:
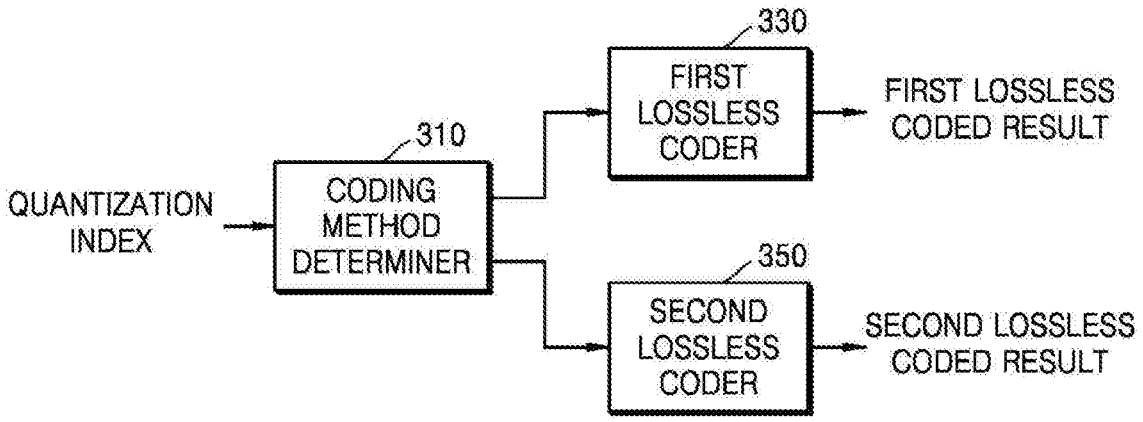
FIG. 3 is a block diagram illustrating a configuration of an energy lossless coding apparatus according to an exemplary embodiment.

FIG. 3 is a block diagram illustrating a configuration of an energy lossless coding apparatus 300 according to an exemplary embodiment.

The energy lossless coding apparatus 300 of FIG. 3 may include a coding method determiner 310, a first lossless coder 330, and a second lossless coder 350. Each of the elements may be integrated into one or more modules and may be implemented with one or more processors (not shown). An input of lossless coding may be a quantization index or a differential quantization index. Here, the differential quantization index will be described as an example.

In FIG. 3, the coding method determiner 310 may determine one of the first and second coding methods as a coding method for the differential quantization index. When the first coding method is selected, the coding method determiner 310 may provide the differential quantization index to the first lossless coder 330, and when the second coding method is selected, the coding method determiner 310 may provide the differential quantization index to the second lossless coder 350. When at least one of quantization indices in all bands of a frame cannot be represented in [−32, 31] ([−46, 17] for a first index), the coding method determiner 310 may determine the first coding method as a coding method for a quantization index. In detail, the first coding method may code data capable of being represented by 256 or 512 symbols more than 64 symbols, and the second coding method may code data which is limited to 64 symbols. When the first coding method is not required, a coding method where the smaller number of bits is consumed may be selected from the first coding method and the second coding method. In detail, a quantization index for all bands in a current frame may be coded by using a plurality of modes of the second coding method, and one of the first and second coding methods may be determined based on a comparison result which is obtained by comparing the smallest used bit as a result of coding by the plurality of modes, and a used bit as a result of coding by the first coding method. In response to a coding method determination result, 1-bit side information D0 indicating a coding method of a differential quantization index may be generated and added into a bitstream. When the second coding method is selected as a coding method, the coding method determiner 310 may divide an N-bit differential quantization index into an upper bit (an N0 bit) and a lower bit (an N1 bit) to then be provided to the second lossless coder 350. Here, N0 may be represented as N−N1, and N1 may be represented as N−N0. According to an exemplary embodiment, N may be set to 6, N0 may be set to 5, and N1 may be set to 1.

When the first coding method (i.e., the large symbol coding method) is determined by the coding method determiner 310, the first lossless coder 330 may select one from among the pulse mode and the scale mode to quantize a quantization index. The pulse mode may be suitable for a case where there is no quantization index which exceeds a range of [−4, 3]. For example, when the quantization index exceeds the range of [−4, 3], the pulse mode may not be used, and instead the scale mode may be always used. Also, when a first index exceeds a range of [−64, 63], the scale mode may be always used. In the large symbol coding method, the Huffman coding mode based on a Huffman coding table having eight symbols illustrated in FIG. 6 may be used.

There may be two indicators in the pulse mode. One of the two indicators is a first indicator "$ind_{lo}$" indicating whether the first index is separately transmitted, and the other is a second indicator "$ind_{pls}$" indicating whether there is a quantization index (i.e., a pulse) which exceeds the range of [−4, 3]. When the first index is within the range of [−4, 3], the first indicator may be set to 0, and the first index may be Huffman-coded along with another index by using the Huffman coding table illustrated in FIG. 6. When the first index is not within the range of [−4, 3], the first indicator may be set to 1 and may be packed by using 7 bits after adding 64 to the first index.

Figures 7, 8:
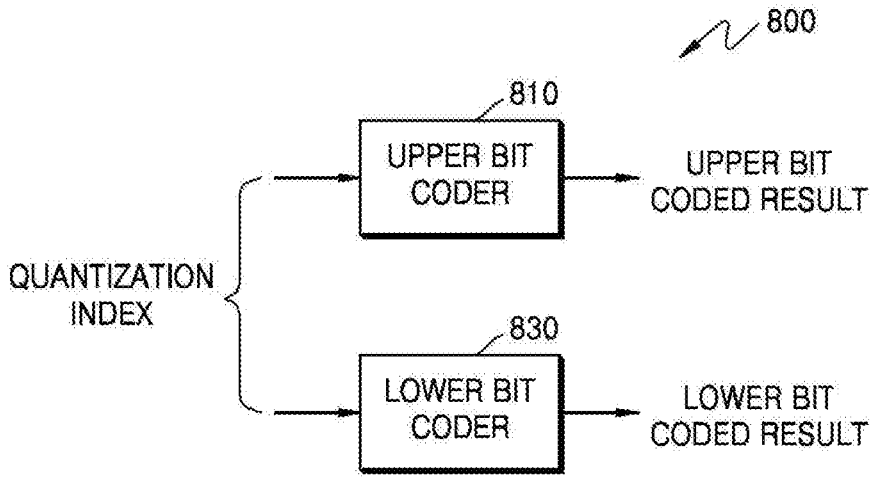
FIG. 7 is a diagram illustrating an example of bit allocation in a pulse mode.
FIG. 8 is a block diagram illustrating a detailed configuration of a second lossless coder of FIG. 3.

When there is a pulse in a current frame, the second indicator may be set to 1, and a pulse position "$pls_{pos}$" and a pulse amplitude "$pls_{amp}$" may be transmitted by respectively using 5 bits and 7 bits. Subsequently, all other indices may be coded by using the Huffman coding table of FIG. 6. An example of bit allocation in the pulse mode is as illustrated in FIG. 7. In FIG. 7, $cmd_0$ indicates a coding method, $cmd_1$ indicates the pulse mode or the scale mode, and $\Delta I_M(0)$ indicates the first index.

In the scale mode, indices may be split into three upper bits and some lower bits, depending on the maximum and minimum of all the indices. The three upper bits may be coded by using the Huffman coding table of FIG. 6, and the lower bits may be packed. The number of lower bits may be defined as $bit_{shift}$. $bit_{shift}$ may be calculated to make all quantization indices fit within the range of [−4, 3] by scaling down the quantization indices. As a scaling result, all quantization indices may be represented by 3 bits.

The second lossless coder 350 may divide the differential quantization index into an upper bit and a lower bit, apply the Huffman coding mode to the upper bit, and perform bit packing on the lower bit.

Figure 4:
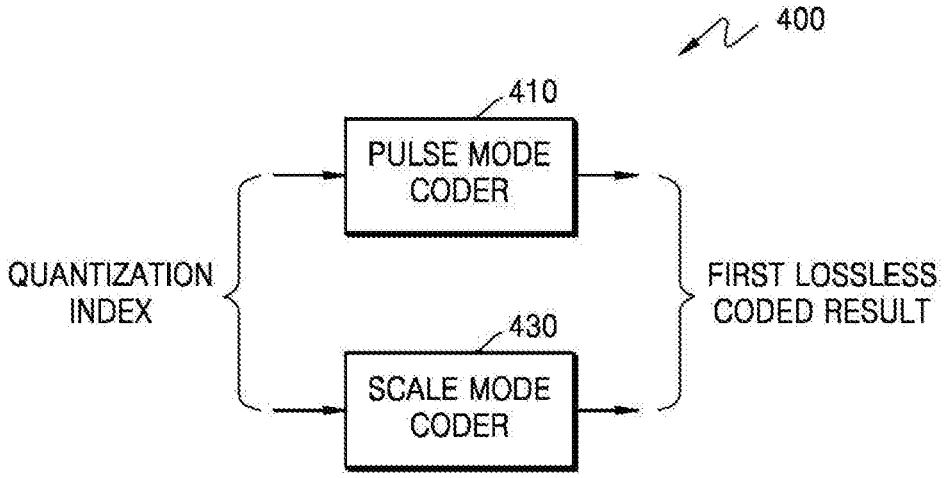
FIG. 4 is a block diagram illustrating a detailed configuration of a first lossless coder of FIG. 3.

FIG. 4 is a block diagram illustrating a detailed configuration of a first lossless coder of FIG. 3.

A first lossless coder 400 of FIG. 4 may include a pulse mode coder 410 and a scale mode coder 430.

Referring to FIG. 4, when some data of an input differential quantization index are not within a finite representation range, the pulse mode coder 410 may efficiently used. That is, the pulse mode coder 410 may separately code the some data (i.e., a pulse), and may code the other data by using the Huffman coding mode.

In detail, in the pulse mode, information about whether a first quantization index is separately transmitted, the first quantization index $\Delta I_M(0)$ when it is determined that the first quantization index is separately transmitted, information about the existence of a pulse, and information about a position and an amplitude of the pulse when the pulse exists may be transmitted as side information. Other quantization indices which are not transmitted in this manner may be transmitted based on a Huffman coding method.

When a differential quantization index vector has a plurality of large values, the scale mode coder 430 may efficiently used. That is, the scale mode coder 430 may reduce a value of all vectors to a range where all vectors are capable of being represented by the Huffman coding mode, to be allocated to an upper bit, and configure a lower bit based on at least one bit which are removed by a reducing operation. In detail, in the scale mode, all values of an input differential quantization index vector may be scaled down to reduce the values to a range which is transmittable by the Huffman coding method, and the number of right-shifted bits may be transmitted as scaling information. In addition, at least one lower bit (for example, a least significant bit), which is removed in a scaling operation may be transmitted through bit packing, and values which are reduced through the scaling operation may be transmitted based on the Huffman coding method.

FIG. 8 is a block diagram illustrating a detailed configuration of a second lossless coder of FIG. 3.

A second lossless coder 800 of FIG. 8 may include an upper bit coder 810 and a lower bit coder 830.

Referring to FIG. 8, the upper bit coder 810 may code an upper bit of a differential quantization index, and the lower bit coder 830 may pack a lower bit of the differential quantization index.

Here, the differential quantization index may be adjusted to have a positive value by adding 46 to a first band and adding 32 to other bands before the differential quantization index is split into the upper bit and the lower bit. In detail, the differential quantization index obtained through Equation (4) may be constrained to a range of [0, 63] by adding the first band to an offset of 46 and adding the other bands to an offset of 32. When a constrained differential quantization index exceeds the range of [0, 63] in a case where a current frame is not a transient frame, and the constrained differential quantization index exceeds the range of [0, 31] in a case where the current frame is the transient frame, the large symbol coding method may be used.

In detail, the upper bit coder 810 may configure $2^{N0}$ symbols for the upper bit expressed by an N0 bit, and may perform coding by using a mode, where a smaller number of bits are consumed, among a plurality of Huffman coding modes. The upper bit coder 810 may have, for example, two kinds of Huffman coding modes. In this case, 1-bit side information D1 indicating a coding mode of the upper bit may be added into a bitstream along with 1-bit side information D0 indicating a coding method.

The lower bit coder 830 may perform coding by applying a bit packing method to the lower bit expressed by an N1 bit. When one frame is configured with $N_b$ number of bands, the lower bit may be coded by using a total of $N1 \times N_b$ bits.

Figures 9, 10:
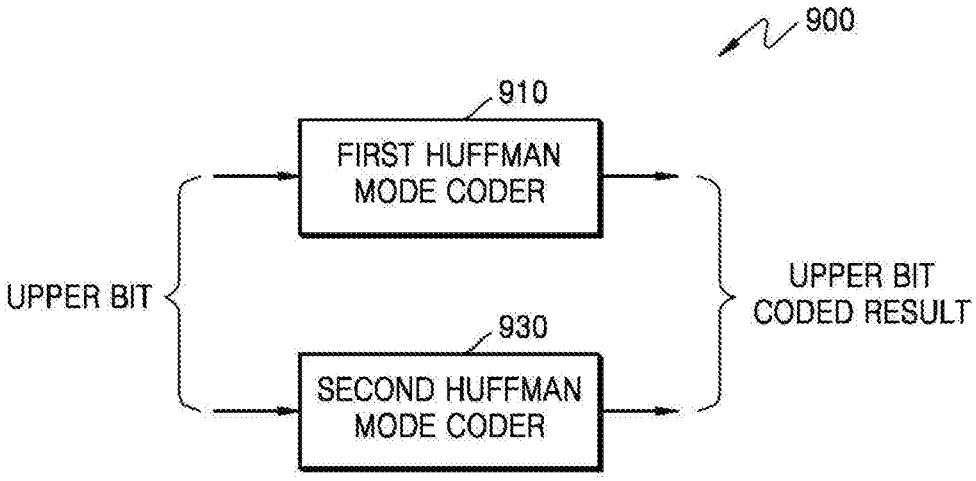
FIG. 9 is a block diagram illustrating a detailed configuration of an upper bit coder of FIG. 8.
FIG. 10 illustrates an example of grouping contexts which are used in a first Huffman mode coder of FIG. 9.

FIG. 9 is a block diagram illustrating a detailed configuration of an upper bit coder of FIG. 8.

An upper bit coder 900 of FIG. 9 may include a first Huffman mode coder 910 and a second Huffman mode coder 930.

Referring to FIG. 9, the first Huffman mode coder 910 may code an upper bit of a differential quantization index, based on the context-based Huffman coding mode. The second Huffman mode coder 930 may code the upper bit of the differential quantization index, based on the resized Huffman coding mode.

The first Huffman mode coder 910 may divide a range of a differential quantization index of a preceding band, which is used as a context, into a plurality of groups and perform Huffman coding on a differential quantization index of a current band, based on a Huffman coding table which is predetermined for each of the plurality of groups. Here, the Huffman coding table may be generated through, for example, a training process using a large-sized database. In detail, data may be collected based on a certain reference, and the Huffman coding table may be generated based on the collected data. According to an exemplary embodiment, data about a frequency number of a differential quantization index of a current band may be collected based on a range of a differential quantization index of a preceding band, and the Huffman coding table may be generated for each group.

Various distribution models may be selected by using an analysis result of a probability distribution of a differential quantization index of a current band which is obtained by using a differential quantization index of a preceding band as a context, and thus, quantization levels having similar distribution models may be grouped. A parameter of each of group indices "0" to "2" is shown in FIG. 10.

Referring to a probability distribution of each group, it may be seen that probability distributions of the group indices "0" and "2" are similar and are substantially inversed about an X axis. This denotes that the same probability model may be applied to two group indices "0" and "2" without a loss of coding efficiency. That is, the group index "0" may use the same Huffman coding table as that for the group index "2". A Huffman coding table "1" (i.e., a probability model "1") for the group index "1" and a Huffman coding table "0" (i.e., a probability model "0") shared by the group indices "0" and "2" may be used. In this case, an index of a code for the group index "0" is represented on the contrary to the group index "2". That is, when a Huffman coding table for a differential quantization index of a current band is determined as the group index "0" by a differential quantization index of a preceding band which is a context, a differential quantization index "d(i)" of the current band may be changed to a value of a reversing operation (i.e., d'(i)=A−d(i)) in a coding end, and Huffman coding may be performed with reference to a Huffman coding table of the group index "2". In a decoding end, Huffman decoding is performed with reference to the Huffman decoding table of the group index "2", and then a d(i) value is finally extracted through a conversion operation of d(i)=A−d'(i). Here, an A value may be set as a value which enables probability distributions of the group indices "0" and "2" to be symmetrical. The A value may not be extracted through a coding and decoding operation but may be previously set as an optimal value. The Huffman coding table of the group index "0" instead of the Huffman coding table of the group index "2" may be used, and a differential quantization index may be changed in the group index "2". According to an exemplary embodiment, when d(i) has a value of a range of [0, 31], the A value may use 31.

To provide a more detailed description on the context-based Huffman coding mode, two kinds of Huffman coding tables determined by a probability distribution of differential quantization indices of three groups may be used. Here, in Huffman-coding a differential quantization index "d(i)" of a current band, a case where a differential quantization index "d(i−1)" of a preceding band is used as a context and the Huffman coding table "1" for the group index "1" and the Huffman coding table "0" for the group index "2" are used will be described as an example.

First, whether the differential quantization index "d(i−1)" of the preceding band is included in the group index "1" is determined. When the differential quantization index "d(i−1)" of the preceding band is included in the group index "1", a code for the differential quantization index "d(i)" of the current band is selected from the Huffman coding table "1". When the differential quantization index "d(i−1)" of the preceding band is not included in the group index "1", whether the differential quantization index "d(i−1)" of the preceding band is included in the group index "0" is determined.

When the differential quantization index "d(i−1)" of the preceding band is not included in the group index "0", namely, when the differential quantization index "d(i−1)" of the preceding band is included in the group index "2", the code for the differential quantization index "d(i)" of the current band is selected from the Huffman coding table "0". When the differential quantization index "d(i−1)" of the preceding band is included in the group index "0", reverse processing is performed for the differential quantization index "d(i)" of the current band, and a code for a reverse-processed differential quantization index "d'(i)" of the current band is selected from the Huffman coding table "0".

Huffman coding is performed for the differential quantization index "d(i)" of the current band by using each of the selected codes.

The second Huffman mode coder 930 may perform Huffman coding without a context, and configure a Huffman coding table with a smaller number of symbols than a general Huffman coding table. The second Huffman mode coder 930 may obtain a new differential quantization index "$\Delta I'_M(b)$" by reducing a span of a differential quantization index while enabling the differential quantization index to be perfectly reconstructed. A span of a differential quantization index of a current band may be modified based on a differential quantization index of a preceding band and a threshold value. A range of the new differential quantization index "$\Delta I'_M(b)$" for Huffman coding may be obtained as Range=[RangeMin, RangeMax]=[Min($\Delta I'_M(b)$), Max($\Delta I'_M(b)$)], (where b is 1, . . . , Nbands−1).

Based on the range obtained in this manner, a range difference "$Range_{Diff}$" may be calculated as expressed in the following Equation (6).

$$Range_{Diff}=Max(15-Range_{Min},Range_{Max}-15) \quad \text{Equation (6)}$$

Resized Huffman coding performed by the second Huffman mode coder 930 may be used for a new differential quantization index when the range difference "$Range_{Diff}$" is equal to or less than a certain value, for example, 11. When the range difference "$Range_{Diff}$" is greater than the certain value, the resized Huffman coding may not be used.

Figure 11:
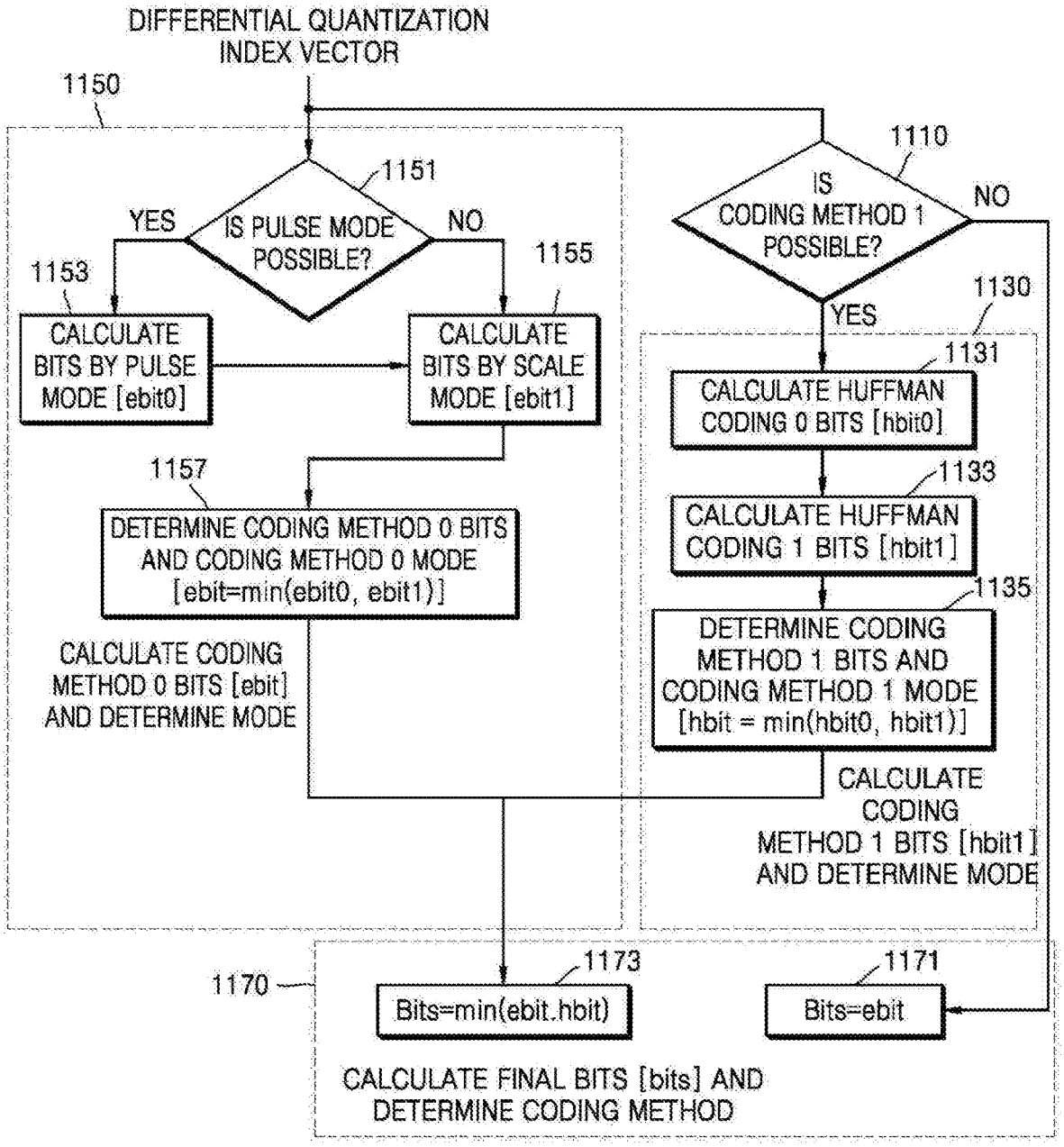
FIG. 11 is a flowchart describing a bit calculating operation for determining a coding method, according to an exemplary embodiment.

FIG. 11 is a flowchart for describing a process of calculating bits for determining a coding method and a coding mode for lossless coding, and the operation may be performed in units of a frame. To summarize, optimal bits of a coding method "0" (i.e., the large symbol coding method) and a coding method "1" (i.e., the small symbol coding method) is calculated, and a coding method which has a smaller value is determined.

In FIG. 11, the coding method "0" (i.e., the large symbol coding method) will be first described.

In operation 1511, the lossless energy coding apparatus 300 determines whether the pulse mode may be performed. When the pulse mode may be performed, the lossless energy coding apparatus 300 performs the pulse mode to calculate a used bit "ebit0" in operation 1153. When the pulse mode may not be performed, the lossless energy coding apparatus 300 performs the scale mode to calculate a used bit "ebit1" in operation 1155. In operation 1157, a smaller value among the used bit "ebit0" and the used bit "ebit1" is allocated as ebit, and a coding mode corresponding to the smaller value is determined as a coding mode of the coding method "0".

Next, the coding method "1" (i.e., the small symbol coding method) will be described.

In operation 1110, the lossless energy coding apparatus 300 determines whether the coding method "1" may be performed, and when a differential quantization index is configured as an input on which the coding method "1" may be performed, the lossless energy coding apparatus 300 calculates a necessary bit. For example, the lossless energy coding apparatus 300 determines whether the differential quantization index may be expressed by N=6 (N0=5, N1=1) bits, and when the differential quantization index may not be expressed by 6 bits, the lossless energy coding apparatus 300 determines a coding method as the large symbol coding method and calculates a used bit in operation 1171. The lossless energy coding apparatus 300 sets a coding method bit to 0, and then embeds information corresponding to ebit, in a bitstream. When the differential quantization index may be expressed by 6 bits, the lossless energy coding apparatus 300 performs a Huffman coding mode "0" to calculate a used bit "hbit0" in operation 1131, and performs a Huffman coding mode "1" to calculate a used bit "hbit1" in operation 1133. In operation 1135, a smaller value among the used bit "hbit0" and the used bit "hbit1" is allocated as hbit, and a coding mode corresponding to the smaller value is determined as a coding mode of the coding method "1". Here, when a 1 bit indicating a coding mode in calculating hbit and a bit "Nb" used to code a lower bit are 20, 20 bits may be further considered.

In operation 1173, a coding method which uses a smaller bit among hbit which is calculated in operation 1135 and ebit which is calculated in operation 1157 is determined, and a coding method bit corresponding to the determined coding method is set.

Figure 12:
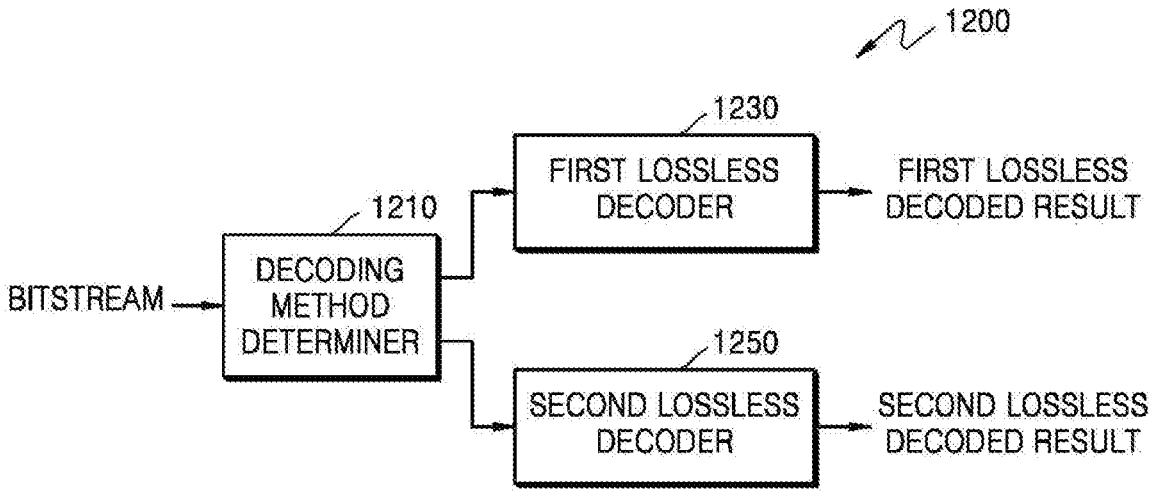
FIG. 12 is a block diagram illustrating a configuration of an energy lossless decoding apparatus according to an exemplary embodiment.

FIG. 12 is a block diagram illustrating a configuration of an energy lossless decoding apparatus 1200 according to an exemplary embodiment.

The energy lossless decoding apparatus 1200 of FIG. 12 may include a decoding method determiner 1210, a first lossless decoder 1230, and a second lossless decoder 1250. Each of the elements may be integrated into one or more modules and may be implemented with one or more processors (not shown).

In FIG. 12, the decoding method determiner 1210 may parse a bitstream to obtain information about a coding method and a coding mode from side information. That is, the decoding method determiner 120 may determine one of a large symbol decoding method and a small symbol decoding method by using a flag bit associated with a coding method. For example, when the large symbol decoding method is determined, a transmitted differential quantization index may be provided to the first lossless decoder 1230, and when the small symbol decoding method is determined, the transmitted differential quantization index may be provided to the second lossless decoder 1250.

The first lossless decoder 1230 may decode a differential quantization index provided from the decoding method determiner 1210, based on the large symbol decoding method. Inverse processing of the pulse mode or the scale mode in lossless coding may be used for lossless decoding based on the large symbol method.

The second lossless decoder 1250 may decode the differential quantization index provided from the decoding method determiner 1210, based on the small symbol decoding method. To this end, lossless decoding may be separately performed for each of an upper bit and a lower bit of the differential quantization index.

Figure 13:
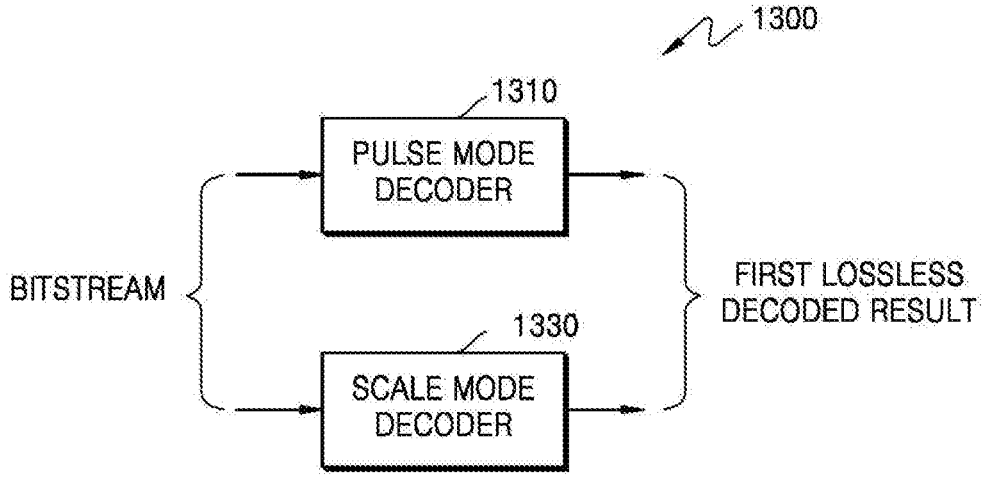
FIG. 13 is a block diagram illustrating a detailed configuration of a first lossless decoder of FIG. 12.

FIG. 13 is a block diagram illustrating a detailed configuration of a first lossless decoder of FIG. 12.

A first lossless decoder 1300 of FIG. 13 may include a pulse mode decoder 1310 and a scale mode decoder 1330.

Referring to FIG. 13, when the pulse mode is determined from a flag bit associated with a coding mode included in a bitstream, the pulse mode decoder 1310 may decode a differential quantization index and perform an inverse operation of the pulse mode coder 410 of FIG. 4.

When the scale mode is determined from the flag bit associated with the coding mode included in the bitstream, the scale mode decoder 1330 may decode a differential quantization index and perform an inverse operation of the scale mode coder 430 of FIG. 4.

Figure 14:
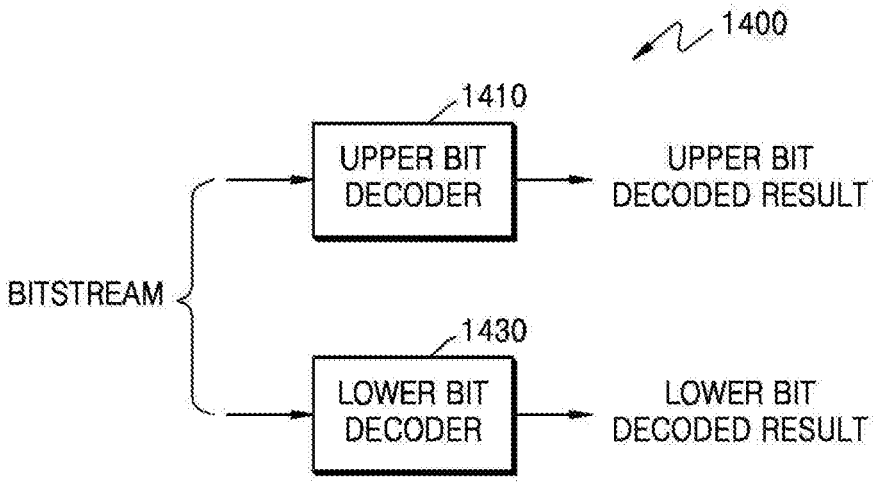
FIG. 14 is a block diagram illustrating a detailed configuration of a second lossless decoder of FIG. 12.

FIG. 14 is a block diagram illustrating a detailed configuration of a second lossless decoder of FIG. 12.

A second lossless decoder 1400 of FIG. 14 may include an upper bit decoder 1410 and a lower bit decoder 1430.

Referring to FIG. 14, the upper bit decoder 1410 may decode upper bits of a differential quantization index, and the lower bit decoder 1430 may unpack lower bits of the differential quantization index to obtain a reconstructed lower bit.

Figure 15:
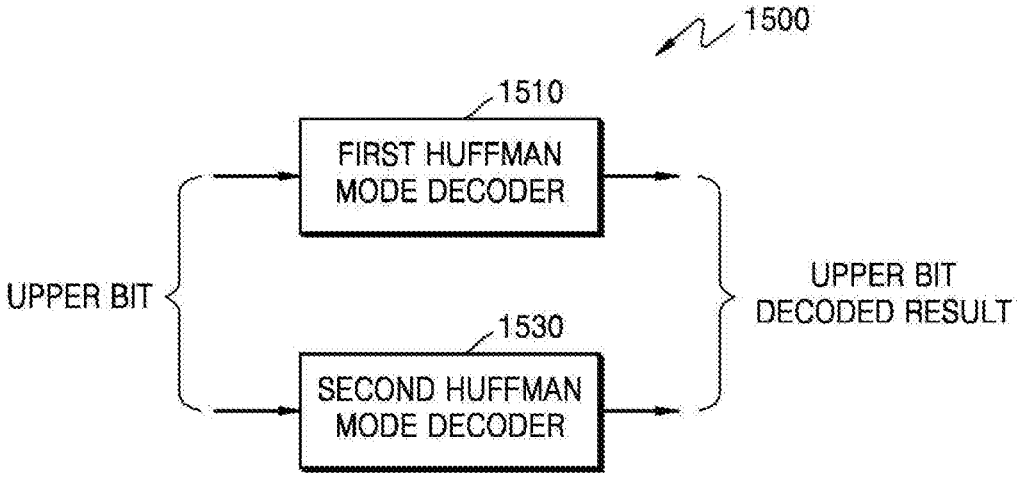
FIG. 15 is a block diagram illustrating a detailed configuration of an upper bit decoder of FIG. 13.

FIG. 15 is a block diagram illustrating a detailed configuration of an upper bit decoder of FIG. 13.

An upper bit coder 1500 of FIG. 15 may include a first Huffman mode decoder 1510 and a second Huffman mode decoder 1530.

Referring to FIG. 15, the first Huffman mode decoder 1510 may decode an upper bit of a differential quantization index, based on the context-based Huffman decoding. The second Huffman mode decoder 1530 may decode the upper bit of the differential quantization index, based on the resized Huffman decoding.

In detail, when a flag bit associated with a coding method included in a bitstream indicates a small coding method, the flag bit associated with the coding mode may be extracted. The coding mode may be one of the context-based Huffman coding mode and the resized Huffman coding mode.

Similarly to the first Huffman mode coder 910 of FIG. 9, the first Huffman mode decoder 1510 may use two kinds of Huffman decoding tables determined by a probability distribution of differential quantization indices of three groups. Here, in Huffman-decoding a differential quantization index "d(i)" of a current band, a case where a differential quantization index "d(i−1)" of a preceding band is used as a context and a Huffman decoding table "1" for a group index "1" and a Huffman decoding table "0" for a group index "2" are used will be described as an example.

First, whether the differential quantization index "d(i−1)" of the preceding band is included in the group index "1" is determined. When the differential quantization index "d(i−1)" of the preceding band is included in the group index "1", a code for the differential quantization index "d(i)" of the current band is selected from the Huffman decoding table "1". When the differential quantization index "d(i−1)" of the preceding band is not included in the group index "1", whether the differential quantization index "d(i−1)" of the preceding band is included in the group index "0" is determined.

When the differential quantization index "d(i−1)" of the preceding band is not included in the group index "0", namely, when the differential quantization index "d(i−1)" of the preceding band is included in the group index "2", the code for the differential quantization index "d(i)" of the current band is selected from the Huffman decoding table "0". When the differential quantization index "d(i−1)" of the preceding band is included in the group index "0", reverse processing is performed for the differential quantization index "d(i)" of the current band, and a code for a reverse-processed differential quantization index "d'(i)" of the current band is selected from the Huffman decoding table "0".

Huffman decoding is performed for the differential quantization index "d(i)" of the current band by using each of the selected codes.

Similarly to the second Huffman mode coder 930 of FIG. 9, the second Huffman mode decoder 1530 may perform Huffman decoding on a differential quantization index in different methods according to whether a current fame is a transient frame.

Figure 16:
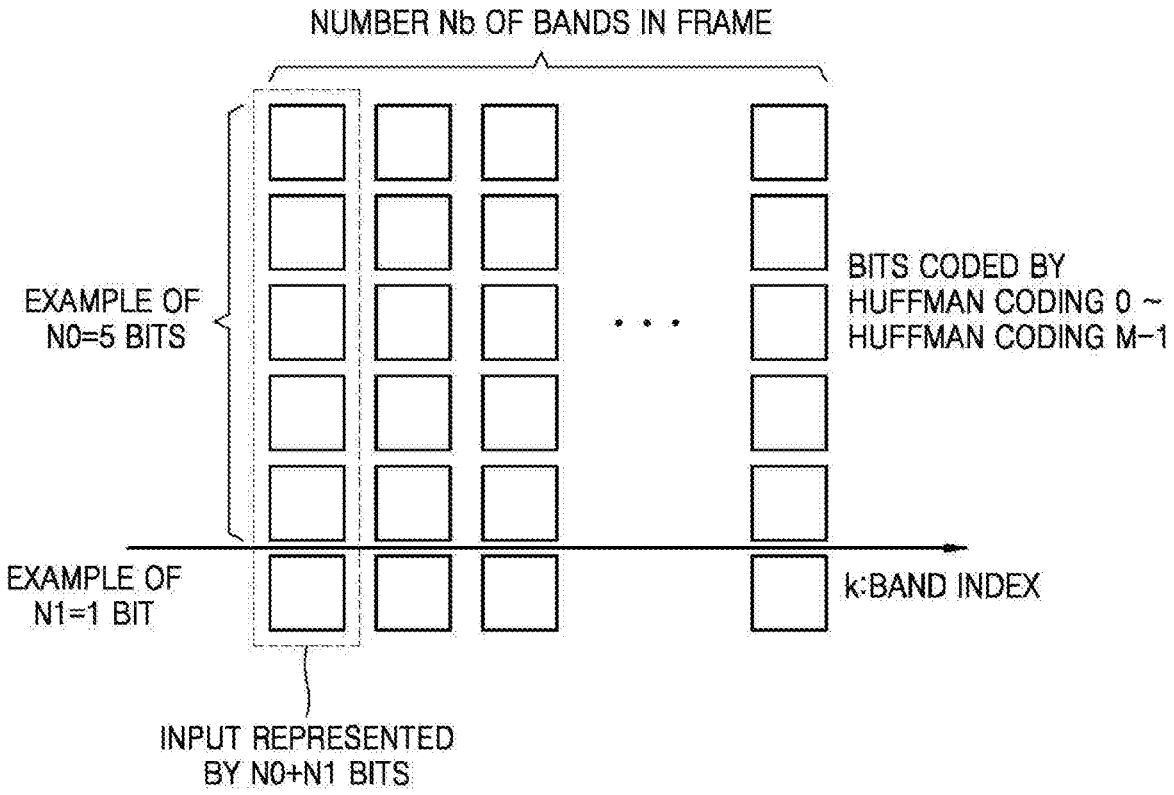
FIG. 16 is a diagram for describing a small symbol coding method.

FIG. 16 is a diagram for describing an energy quantization index coded by a first coding method, namely, a small symbol coding method. A case where N is 6 and N1 is 1 is illustrated as an example. Referring to FIG. 16, upper 5 bits may use a Huffman coding mode, and lower 1 bit may be used to simply pack bits.

Figure 17:
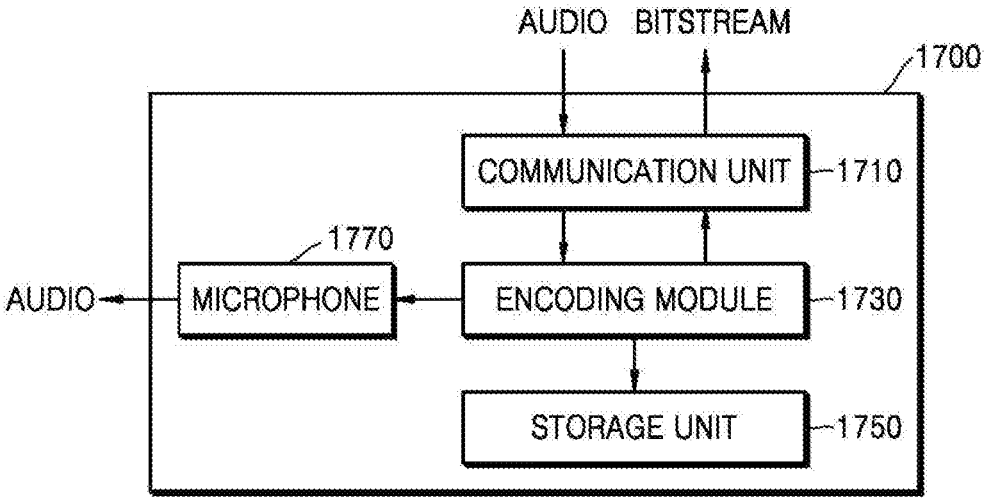
FIG. 17 is a block diagram of a multimedia device according to an exemplary embodiment.

FIG. 17 is a block diagram of a multimedia device including an encoding module, according to an exemplary embodiment.

Referring to FIG. 17, the multimedia device 1700 may include a communication unit 1710 and the encoding module 1730. In addition, the multimedia device 1700 may further include a storage unit 1750 for storing an audio bitstream obtained as a result of encoding according to the usage of the audio bitstream. Moreover, the multimedia device 1700 may further include a microphone 1770. That is, the storage unit 1750 and the microphone 1770 may be optionally included. The multimedia device 1700 may further include an arbitrary decoding module (not shown), e.g., a decoding module for performing a general decoding function or a decoding module according to an exemplary embodiment. The encoding module 1730 may be implemented by at least one processor (not shown) by being integrated with other components (not shown) included in the multimedia device 1700 as one body.

The communication unit 1710 may receive at least one of an audio signal or an encoded bitstream provided from the outside or may transmit at least one of a reconstructed audio signal or an encoded bitstream obtained as a result of encoding in the encoding module 1730.

The communication unit 1710 is configured to transmit and receive data to and from an external multimedia device through a wireless network, such as wireless Internet, wireless intranet, a wireless telephone network, a wireless Local Area Network (LAN), Wi-Fi, Wi-Fi Direct (WFD), third generation (3G), fourth generation (4G), Bluetooth, Infrared Data Association (IrDA), Radio Frequency Identification (RFID), Ultra WideBand (UWB), Zigbee, or Near Field Communication (NFC), or a wired network, such as a wired telephone network or wired Internet.

According to an exemplary embodiment, the encoding module 1730 may transform an audio signal of a time domain provided from the communication unit 1710 or the microphone 1770 into an audio spectrum of a frequency domain. The encoding module 1730 may determine a coding method of an energy quantization index as one of a large symbol coding method and a small symbol coding method, and code the energy quantization index based on the determined coding method. In detail, in determining the coding method, when differential coding is applied, the encoding module 1730 may determine one of a large symbol coding method and a small symbol coding method according to whether differential quantization indices of all bands included in a current frame are represented by predetermined bits. Though the differential quantization indices of all bands included in a current frame may be represented by the predetermined bits, a result of coding the differential quantization index by the large symbol coding method and a result of coding the differential quantization index by the small symbol coding method may be compared and then a coding method corresponding to a lower bit consumption may be chosen. The large symbol coding method may include a pulse mode and a scale mode. In the small symbol coding method, the differential quantization index may be split into an upper bit and a lower bit to be separately coded. The upper bit may be coded by a plurality of Huffman coding modes and the lower bit may be coded by bit packing. The coding method and the coding mode determined for the differential quantization index may be generated as side information.

The storage unit 1750 may store the encoded bitstream generated by the encoding module 1730. In addition, the storage unit 1750 may store various programs required to operate the multimedia device 1700.

The microphone 1770 may provide an audio signal from a user or the outside to the encoding module 1730.

Figure 18:
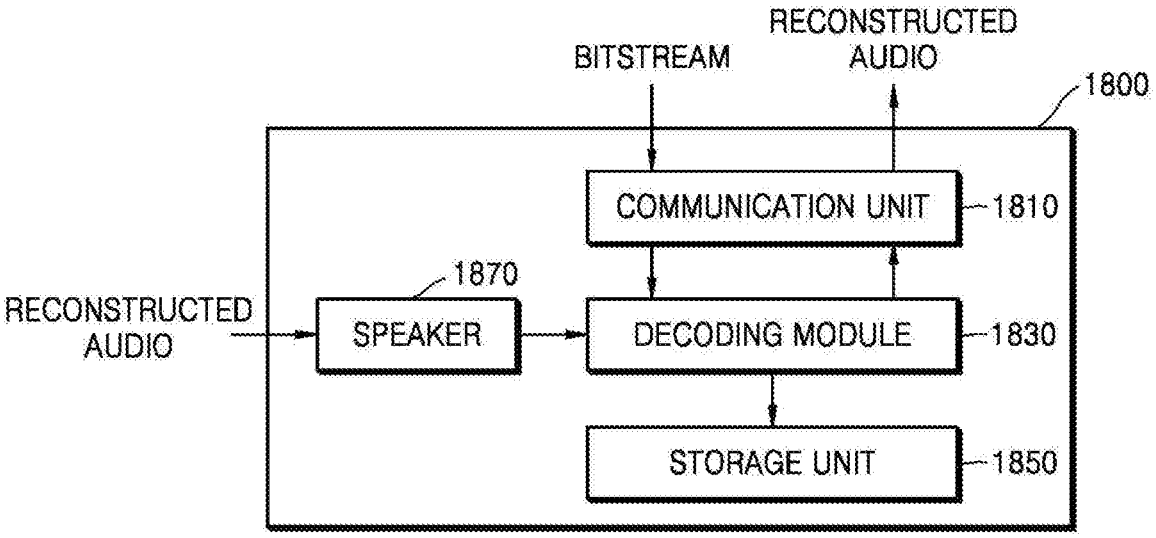
FIG. 18 is a block diagram of a multimedia device according to another exemplary embodiment.

FIG. 18 is a block diagram of a multimedia device including a decoding module, according to an exemplary embodiment.

Referring to FIG. 18, the multimedia device 1800 may include a communication unit 1810 and a decoding module 1830. In addition, according to the usage of a reconstructed audio signal obtained as a result of decoding, the multimedia device 1800 may further include a storage unit 1850 for storing the reconstructed audio signal. In addition, the multimedia device 1800 may further include a speaker 1870. That is, the storage unit 1850 and the speaker 1870 may be optionally included. The multimedia device 1800 may further include an encoding module (not shown), e.g., an encoding module for performing a general encoding function or an encoding module according to an exemplary embodiment. The decoding module 1830 may be implemented by at least one processor (not shown) by being integrated with other components (not shown) included in the multimedia device 1800 as one body.

The communication unit 1810 may receive at least one of an audio signal or an encoded bitstream provided from the outside or may transmit at least one of a reconstructed audio signal obtained as a result of decoding in the decoding module 1830 or an audio bitstream obtained as a result of encoding. The communication unit 1810 may be implemented substantially and similarly to the communication unit 1710 of FIG. 17.

According to an exemplary embodiment, the decoding module 1980 may receive a bitstream provided through the communication unit 1810 and determine a coding method and a coding mode of the differential quantization index based on side information included in a bitstream. The decoding module 1980 may decode the differential quantization index based on the determined coding method and coding mode. The large symbol decoding method may include a pulse mode and a scale mode. In the small symbol decoding method, the differential quantization index may be split into an upper bit and a lower bit to be separately decoded. The upper bit may be decoded by a plurality of Huffman decoding modes and the lower bit may be decoded by bit unpacking.

The storage unit 1850 may store the reconstructed audio signal generated by the decoding module 1830. In addition, the storage unit 1850 may store various programs required to operate the multimedia device 1800.

The speaker 1870 may output the reconstructed audio signal generated by the decoding module 1830 to the outside.

Figure 19:
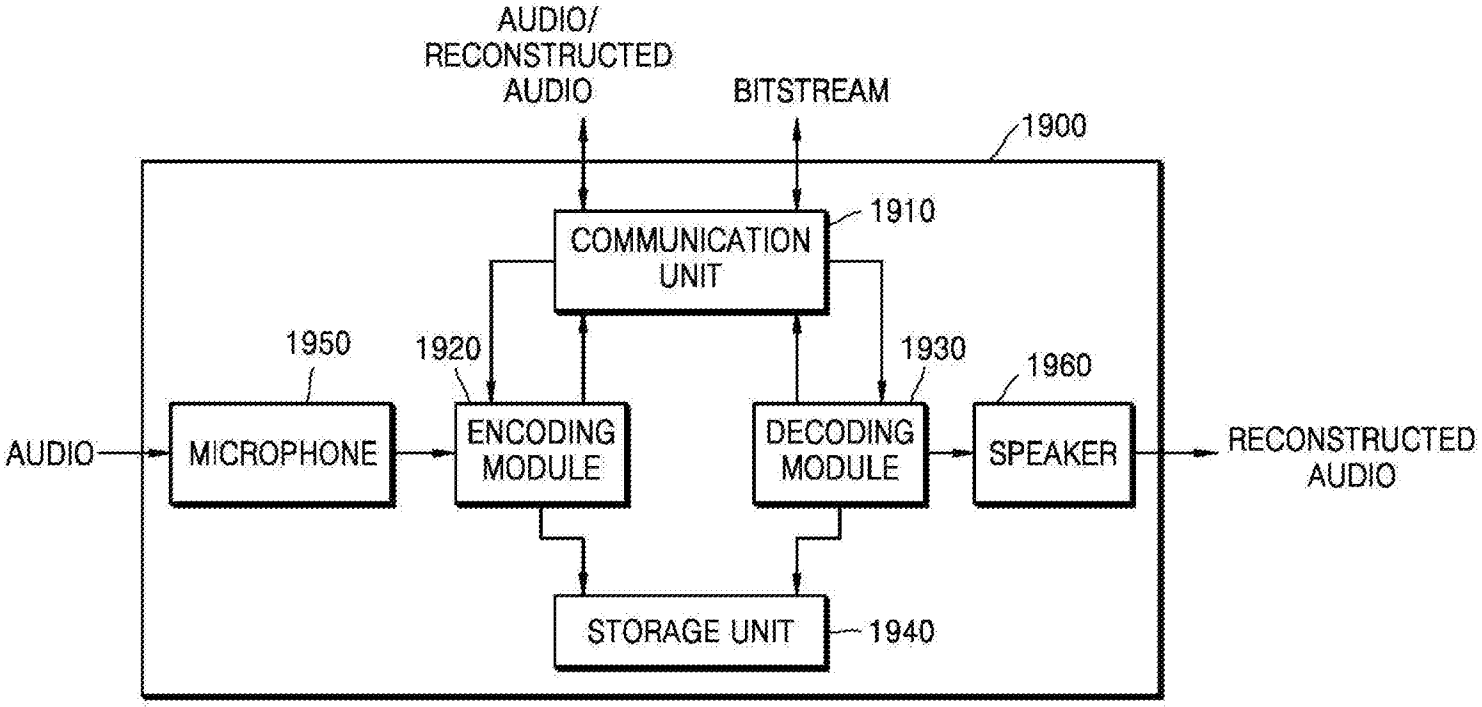
FIG. 19 is a block diagram of a multimedia device according to still another exemplary embodiment.

FIG. 19 is a block diagram of a multimedia device including an encoding module and a decoding module, according to an exemplary embodiment.

Referring to FIG. 19, the multimedia device 1900 may include a communication unit 1910, an encoding module 1920, and a decoding module 1930. In addition, the multimedia device 1900 may further include a storage unit 1940 for storing an audio bitstream obtained as a result of encoding or a reconstructed audio signal obtained as a result of decoding according to the usage of the audio bitstream or the reconstructed audio signal. In addition, the multimedia device 1900 may further include a microphone 1950 and/or a speaker 1960. The encoding module 1920 and the decoding module 1930 may be implemented by at least one processor (not shown) by being integrated with other components (not shown) included in the multimedia device 1900 as one body.

Since the components of the multimedia device 1900 shown in FIG. 19 correspond to the components of the multimedia device 1700 shown in FIG. 17 or the components of the multimedia device 1800 shown in FIG. 18, a detailed description thereof is omitted.

Each of the multimedia devices 1700, 1800, and 1900 shown in FIGS. 17, 18, and 19 may include a voice communication dedicated terminal, such as a telephone or a mobile phone, a broadcasting or music dedicated device, such as a TV or an MP3 player, or a hybrid terminal device of a voice communication dedicated terminal and a broadcasting or music dedicated device but are not limited thereto. In addition, each of the multimedia devices 1700, 1800, and 1900 may be used as a client, a server, or a transducer displaced between a client and a server.

When the multimedia device 1700, 1800, or 1900 is, for example, a mobile phone, although not shown, the multimedia device 1700, 1800, or 1900 may further include a user input unit, such as a keypad, a display unit for displaying information processed by a user interface or the mobile phone, and a processor for controlling the functions of the mobile phone. In addition, the mobile phone may further include a camera unit having an image pickup function and at least one component for performing a function required for the mobile phone.

When the multimedia device 1700, 1800, or 1900 is, for example, a TV, although not shown, the multimedia device 1700, 1800, or 1900 may further include a user input unit, such as a keypad, a display unit for displaying received broadcasting information, and a processor for controlling all functions of the TV. In addition, the TV may further include at least one component for performing a function of the TV.

The above-described exemplary embodiments may be written as computer-executable programs and may be implemented in general-use digital computers that execute the programs by using a non-transitory computer-readable recording medium. In addition, data structures, program instructions, or data files, which can be used in the embodiments, can be recorded on a non-transitory computer-readable recording medium in various ways. The non-transitory computer-readable recording medium is any data storage device that can store data which can be thereafter read by a computer system. Examples of the non-transitory computer-readable recording medium include magnetic storage media, such as hard disks, floppy disks, and magnetic tapes, optical recording media, such as CD-ROMs and DVDs, magneto-optical media, such as optical disks, and hardware devices, such as ROM, RAM, and flash memory, specially configured to store and execute program instructions. In addition, the non-transitory computer-readable recording medium may be a transmission medium for transmitting signal designating program instructions, data structures, or the like. Examples of the program instructions may include not only mechanical language codes created by a compiler but also high-level language codes executable by a computer using an interpreter or the like.

While the exemplary embodiments have been particularly shown and described, it will be understood by those of ordinary skill in the art that various changes in form and details may be made therein without departing from the spirit and scope of the inventive concept as defined by the appended claims. It should be understood that the exemplary embodiments described therein should be considered in a descriptive sense only and not for purposes of limitation. Descriptions of features or aspects within each exemplary embodiment should typically be considered as available for other similar features or aspects in other exemplary embodiments.

What is claimed is:

1. A lossless coding method in an encoding device comprising at least one processor, the method comprising:

selecting a coding method from a plurality of coding methods including a first coding method and a second coding method for coding differential quantization indices of an energy, based on a first predetermined range and bit consumption;

if the first coding method is selected, selecting a mode from a plurality of modes including a pulse mode and a scale mode, based on a second predetermined range different from the first predetermined range, and coding the differential quantization indices by using the selected mode, wherein if the pulse mode is selected, it is determined whether to transmit a first differential quantization index separately, wherein if it is determined not to transmit the first differential quantization index separately, the first differential quantization index is coded along with another differential quantization index by Huffman coding, and if it is determined to transmit the first differential quantization index separately, the first differential quantization index is packed.

2. The method of claim 1, wherein the lossless coding method is performed in units of a frame.

3. The method of claim 1, wherein the selecting the coding method comprises:

selecting the first coding method when at least one differential quantization index of all bands included in a current frame is not represented by the first predetermined range;

selecting the coding method corresponding to a lower bit consumption, from among the first coding method and the second coding method when each of differential quantization indices of all the bands included in the current frame is represented by the first predetermined range; and generating side information indicating the selected coding method.

4. The method of claim 1, wherein the second coding method splits the differential quantization indices into an upper bit and a lower bit to be separately coded.

5. The method of claim 4, wherein the upper bit is coded by using one of a plurality of Huffman coding modes to generate side information indicating a coding mode of the upper bit.

6. The method of claim 5, wherein the plurality of Huffman coding modes comprise a mode using a context and a mode which does not use the context.

7. The method of claim 4, wherein the lower bit is coded through bit packing.

* * * * *